US005355639A

United States Patent [19]

Ferard et al.

[11] Patent Number: 5,355,639

[45] Date of Patent: Oct. 18, 1994

[54] DEVICE FOR MACHINING OF CONTOURS MADE OF A SOFT MATERIAL AND AUTOMATIC MACHINING METHOD USING SUCH A DEVICE

[75] Inventors: Michel Ferard, Argenteuil; Tanguy de Kervenouel, Neauphle le Chateau; Frederic Sgarbi, Paris, all of France

[73] Assignee: Commissariat a L'Energie Atomique, France

[21] Appl. No.: 1,163

[22] Filed: Jan. 7, 1993

Related U.S. Application Data

[63] Continuation-in-part of Ser. No. 717,041, Jun. 18, 1991, abandoned.

[30] Foreign Application Priority Data

Jul. 4, 1990 [FR] France ..... 90 08472

[51] Int. Cl.[5] ..... B24B 45/00

[52] U.S. Cl. ..... 451/496; 451/502; 451/28

[58] Field of Search ..... 51/363, 364, 365, 366, 51/370, 281 R

[56] References Cited

U.S. PATENT DOCUMENTS 2,771,720 11/1956 Field ..... 51/364

4,197,679 4/1980 Yamada et al. ..... 51/281 C

*Primary Examiner*—Bruce M. Kisliuk

*Assistant Examiner*—Eileen Morgan

*Attorney, Agent, or Firm*—Hayes, Soloway, Hennessey, Grossman & Hage

[57] ABSTRACT

Device for machining contours (2) made of a soft material, such as plastic, and essentially including a rotary tool (6) constituted by abrasive elastic plates (5) whose flexibility makes it possible to dampen the jerks of the member (33) bearing the tool (6). Preferably, a pneumatic motor (9) and a speedometer (10) are used to automatically control the tool (6) at a constant speed guaranteeing a stable machining or cutting force. The method for the automatic machining of flexible burrs on a contour formed of a soft material, is also described.

3 Claims, 4 Drawing Sheets

DEVICE FOR MACHINING OF CONTOURS MADE OF A SOFT MATERIAL AND AUTOMATIC MACHINING METHOD USING SUCH A DEVICE

CROSS-REFERENCE TO RELATED APPLICATIONS

This application is a continuation-in-part of copending U.S. application Ser. No. 07/717,041 filed Jun. 18, 1991, now abandoned.

FIELD OF THE INVENTION

The invention concerns a device for machining contours made of a soft material, such as polyurethane or other plastic materials, as well as an automatic machining method adapted to such devices.

BACKGROUND OF THE INVENTION

First and foremost, research has been carried out in order to obtain a clean and smooth machined contour, this being difficult to achieve owing to the tender nature of the material on which the machining jerks, due mainly to the irregularity of the cutting speed, forward movement and cut depth, which are relatively significant in the case of automatic methods, are immediately reflected and cause a poor surface state or undulations. The main objective of the invention is therefore to provide a tool and more generally a device making it possible to embody a good quality machined contour on such materials, even if the machined contour is flexible when, for example, extremely fine rib burrs of several tens of millimeters are suppressed.

Another object of the invention is particularly advantageous for automatic methods and concerns the automatic control of the position of the tool, that is its cut depth. On soft materials, the cutting force, which may provide an estimation of the sought-after cut depth, is in fact extremely slight and is unable to be correctly harnessed. Thus, a further system has been provided to attain a satisfactory result.

SUMMARY OF THE INVENTION

Generally speaking, the machining device of the invention includes a tool constituted by elastic plates embedded at one extremity of a rotary block driven by a motor device. The plates may possibly be made of an elastic cloth coated with abrasive.

If the burrs of the contour to be machined are flexible, it is advantageous to use a non-abrasive brush system pressing on two opposing faces of the contour so as to keep the burrs close to the tool in a state where they lend themselves well to deburring. Thus, the folding back of the burrs by the tool, which could be provoked by the latter and would compromise its efficiency, is avoided by rejecting the burrs outside the range of the plates. Such a system may consist of two brushes bearing the radial elements constituting deflection springs. The brushes then rotate around axes roughly parallel to the faces of the contour.

It is advantageous that the motor device be pneumatic and that the device includes a sensor for measuring the speed of rotation of the tool. It is then possible to adjust the cut depth of the tool by automatically controlling the speed of rotation to the specific value, which may be periodically recalculated according to the off-load speed of rotation and its time variations.

BRIEF DESCRIPTION OF THE DRAWINGS

The invention is now to be described in more detail with the aid of the accompanying four figures, given by way of illustration and being non-restrictive and which represent one embodiment of the invention.

DETAILED DESCRIPTION OF THE PREFERRED EMBODIMENTS

Figure 1:
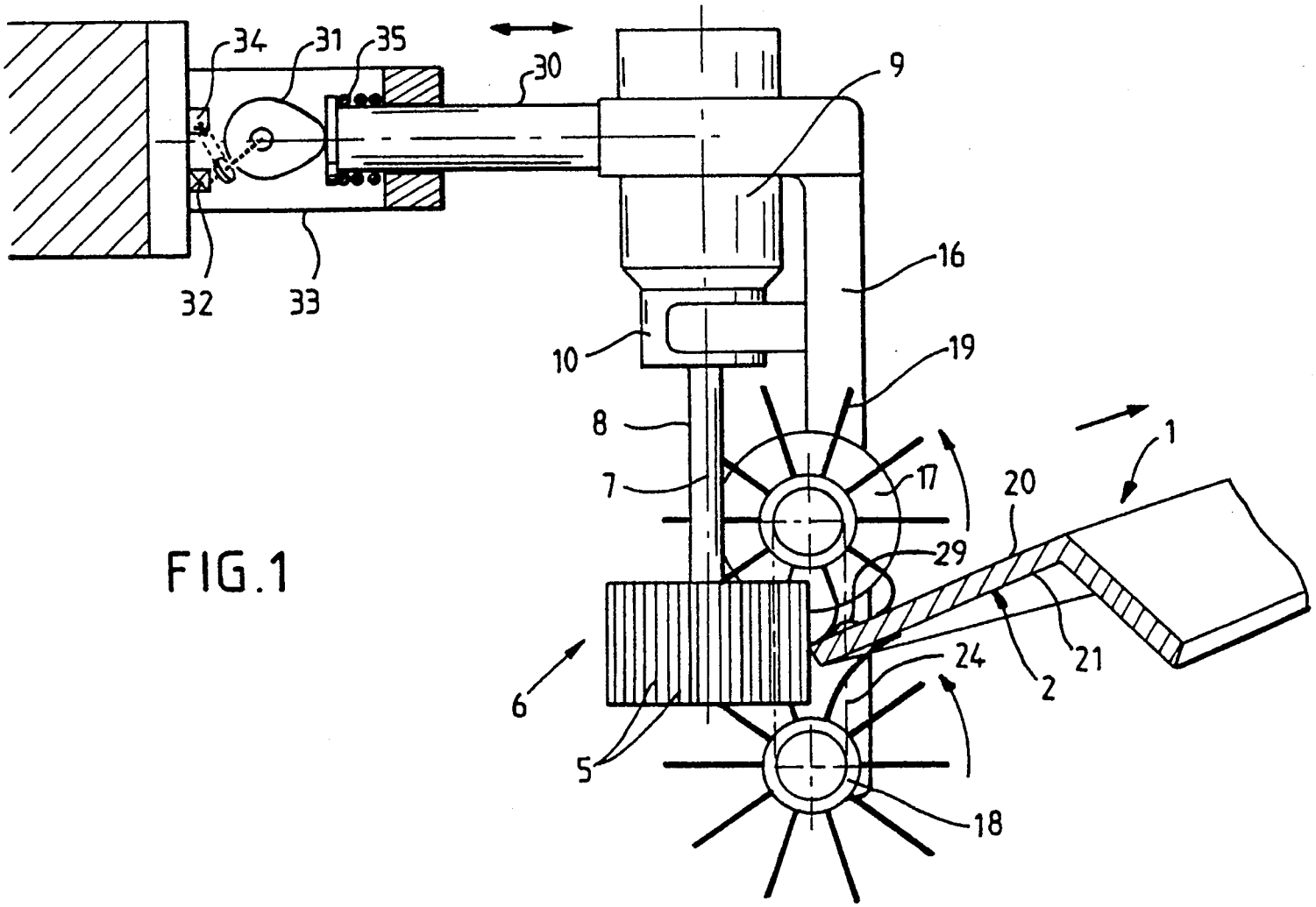
FIGS. 1 and 2 are two views of the complete machining system respectively showing the front and back of the tool.
Figure 2:
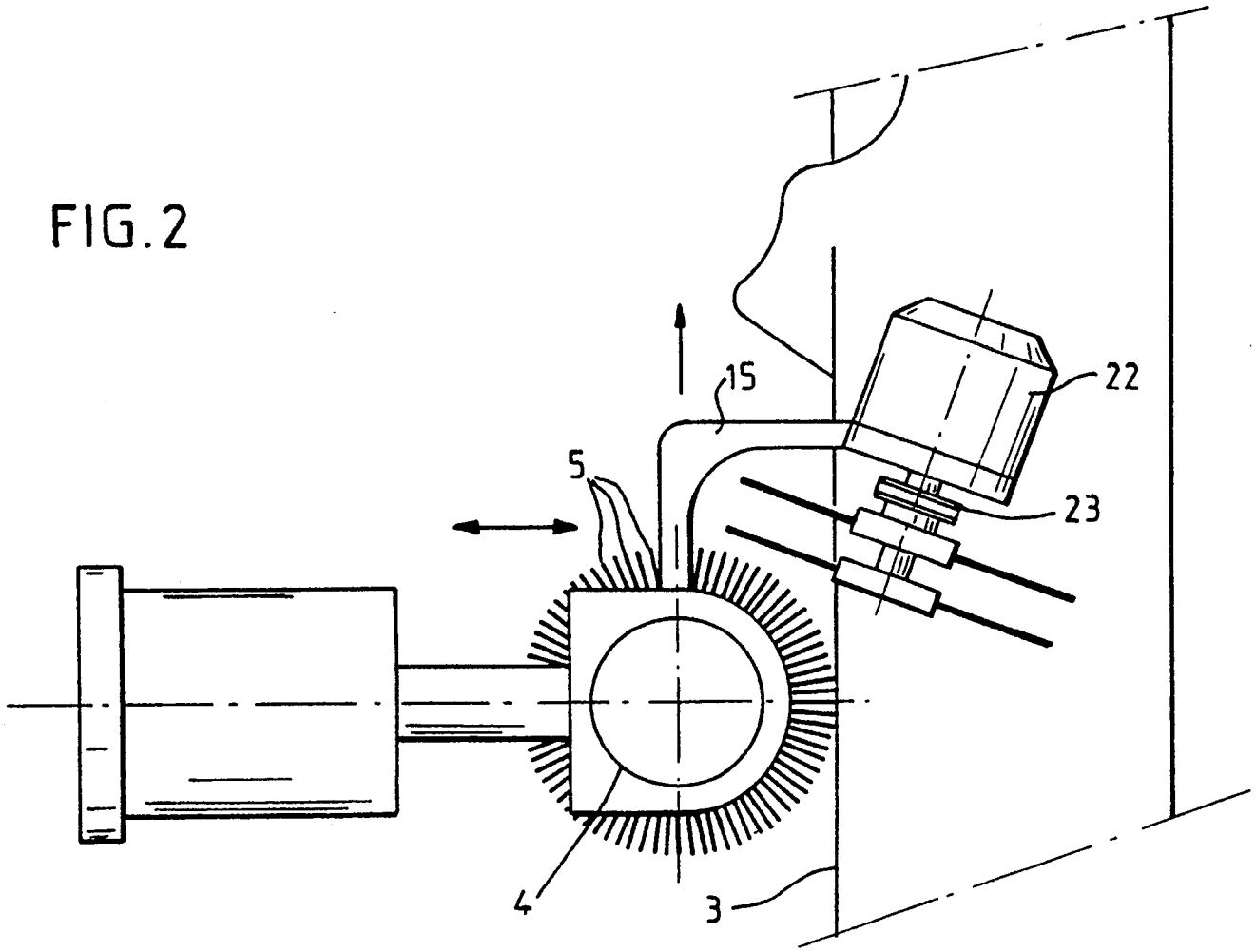

FIGS. 1 and 2 show the piece to be machined 1 including a flange or rib whose edge 3 in FIG. 2 is machined by means of a deburring operation, but the tool to be described hereafter can also be used for other types of machining, especially for bevelling.

It essentially includes a rotary block 4 provided with plates 5 disposed radially and which are situated inside planes through which the axis of rotation 7 of the tool 6 passes. The rotary block 4 is subjected to a pin 8 which moves it under the action of a pneumatic motor 9. The plates 5 are constituted by an elastic cloth with one of its extremities being embedded in the rotary block 4, the other extremity rubbing against the edge 3 along which it is moved. This other extremity is coated with an abrasive powder responsible for machining.

A speedometer 10 fixed to the pneumatic motor 9 measures the speed of rotation of the pin 8 and the tool 6. Moreover, the housing of the pneumatic motor 9 bears a console 15 extended by a girder 16 parallel to the pin 8 and which passes close to the tool 6. The girder 16 bears the axes of two parallel brushes 17 and 18 provided with sets of Nylon hair 19 which, via the rotation of the rushes 17 and 18, rub onto the two plane and opposing faces 20 and 21 of the flange 2 and the edge 3; the axes of rotation of the brushes 17 and 18 are parallel to the faces 20 and 21. The girder 16 is disposed in such a way as to slightly extend next to the flange 2. The hair 19 of the two brushes 17 and 18 have spans which overlap or partially merge, but the brushes 17 and 18 are slightly axially offset and thus remain separated.

A motor 22 secured to the console 15 drives, by means of a first belt 23, one of the brushes 17, and a second belt 24 interconnects the axes of the brushes 17 and 18 so that the second brush is moved.

The hair 19 is deflected by rubbing onto the faces 20 and 21 and is then rectified by virtue of its elasticity. The antagonistic forces thus exerted by the brushes 17 and 18 on the flange 2 and the edge 3 have the effect of bending the flexible burrs which would otherwise deflect under the force of the tool 6 and would be difficult to eliminate. Such a burr bears the reference 29. It is folded around its root (where it is connected to the flange 2) and pressed against the upper edge of the flange 2 by the upper brush 17. The tool 6 then attacks it via the root and thus detaches it from the flange 2 rather than eliminating it. It shall be observed that the tool 6 is placed obliquely with respect to the surfaces of the flange and only removes material on the edge bearing the burr 29, in other words bevelling it. The tool 6 with the plates 5 is clearly preferable in such a situation to a rotary brush provided with abrasive hair as the abrasive elastic structures need to be sufficiently close to the region to be deburred so as to exert an adequate abrasion force. Hair would thus be brought onto portions of the surface of the flange 2 close to the region to be deburred, which would thus be striated, which is not aesthetically acceptable in most cases, in contrast the plates 5 are bent over their entire height.

The lower brush 18 is intended to move the burr 29 if necessary so as to place it within the range of the upper brush 17.

Figure 4:
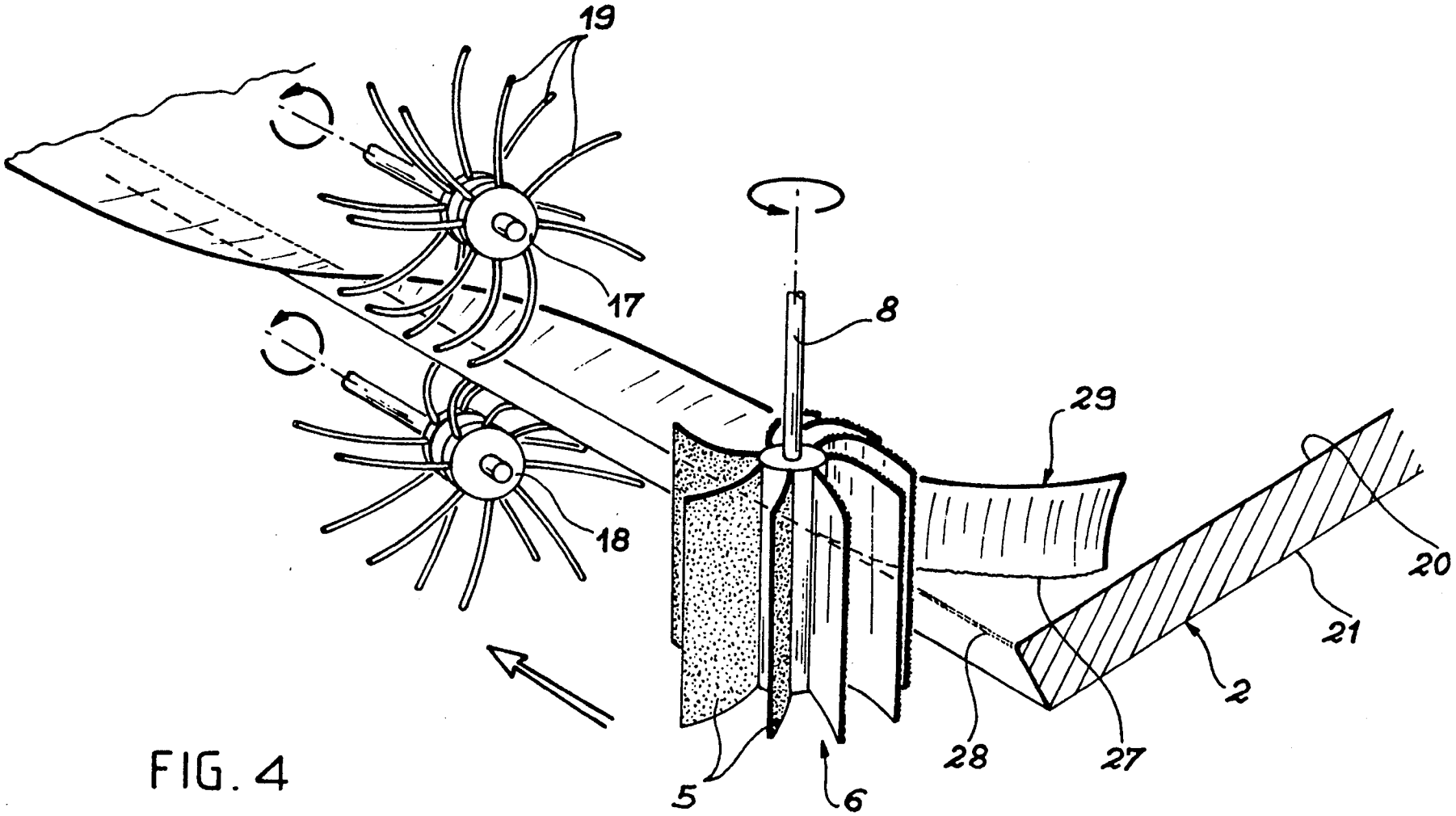
FIG. 4 precisely depicts how deburring is done with the invention.

FIG. 4 is an explanatory view of the process. The deflection of the burr 29 by the upper brush 17 is shown as well as how the tool 6 exerts an abrasion localized at the root 27. As a result deburring is achieved with an almost uniform pressure of the plates 5 on the contour 28 which acquires a regular and smooth aspect. The burr 29 is removed totally irrespective of its height and its thickness which can both vary greatly in practice along the contour 28. Such variations usually render automatic deburrings difficult.

The pneumatic motor 9 is disposed at one extremity of a slide 30, its other extremity being pushed back by a cam 31 activated by a motor 32. A recall system, such as a spring 35, keeps the extremity of the slide 30 against the cam 31; furthermore, all these pieces are housed in a terminal member 33 of a robot arm, not shown in detail and programmed to roughly follow the edge 3 to be machined. The slide 30 is approximately held in a direction where its sliding enables it to approach or move the tool 6 from the edge 3 and thus modify the cutting force; the machining stages consist of moving the terminal member 33 along the contour 2 while adjusting the cut depth by causing the slide 30 to constantly slide.

A potentiometer 34 records the movements of the motor 32 and thus those of the cam 31.

Figure 3:
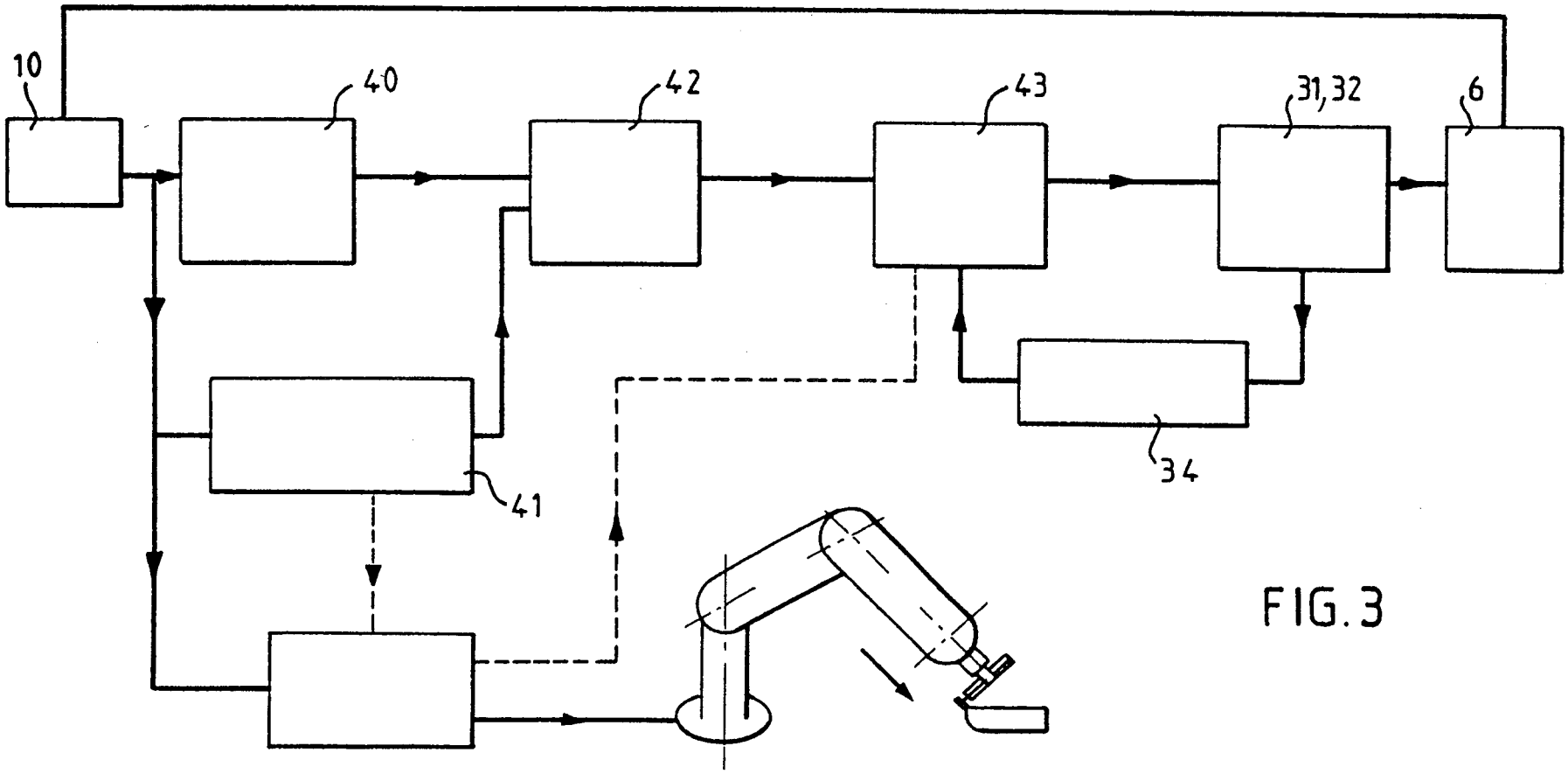
FIG. 3 is a flowchart showing the mode for the automatic control of the device.

Reference is now made to FIG. 3 in order to examine how the tool 6 is automatically controlled, but it is first of all necessary to consider the machining conditions forming part of the technical context of the invention.

So as to guarantee a uniform cut depth, operation may be effected with a constant force, but if the material is soft, the force is extremely slight, namely about several grams, and could thus only be measured without excessive noise by a force sensor linked to the pin 8.

In fact, it is possible to estimate with acceptable accuracy the cutting force with the aid of the speed of rotation of the pin 8, especially when this pin 8 is driven by a pneumatic motor 9.

The following equation may therefore be written:

$$C = J_{\omega'} + B_{\omega} + Cext$$

where C is the motor torque, J the inertia of the portions driven around the axis of rotation 7, B is a coefficient representing losses by viscous friction, Cext is the torque exerted by the machined material, which directly depends on the cutting force, and $\omega'$ and $\omega$ denote the speed of rotation of the tool 6 and its acceleration. As the motor torque C is proportional to the feed pressure of the pneumatic motor 9, it may be known with extreme precision and similarity it is possible to accurately estimate J and B by means of a preliminary calibration.

A speedometer 10 is connected via its output to a filtering system 40 which calculates the real speed $\omega_1$ at each moment. A reference variable speed supply system 41 simultaneously supplies the reference speed $\omega_c$ to be observed. A calculation system 42 collects the two speeds $\omega_1$ and $\omega_c$ and calculates the angular position Pc of the cam 31 for which the real speed w1 ought to become equal to the reference variable speed and which is equal, a constant multiplicative coefficient not taken into account, to $$Pc = \int_{t0}^{t1} A(\omega 1 - \omega 2)dt$$

where t1 denotes the moment in question, t0 the moment of the start of the measurements and A is a lead-in phase corrector. The result of this analog calculation is sent to an actuation system 43 which activates the motor 32 and thus modifies the real position Pr of the cam 31 it knows by means of the potentiometer 34 until it is made to coincide with the previously calculated angular position Pc. The modification of the position of the tool 6 resulting from the above is expressed by a convergence of the real speed $\omega_1$ towards the reference variable speed $\omega_c$.

This system has an extremely short reaction time.

The reference variable speed $\omega_c$ may be selected as being proportional to the off-load speed of rotation of the tool 6. As this off-load speed of rotation varies according to the time involved, especially following variations of the feed pressure, temperature or lubrication conditions, the reference variable speed wc needs to be recalculated from time to time by the reference variable speed supply system 41. In practice, it is possible to carry out a measurement each time the tool 6 is freed so as to carry out a new machining stage.

During these disengagements, the previously described automatic control is interrupted and the cam 31 is brought back to a fixed position where the slide is at mid-travel. When a new machining stage is carried out, the tool 6 is brought to several millimeters from the edge 3, then the terminal member 33 slowly approaches the edge 3 until it touches it (in the direction of the arrow shown on FIG. 3), after which a reduction of the speed of rotation is detected and the trajectory provided to the robot is covered by reassuming automatic control.

What is claimed is:

1. A device for machining a flexible burr on a contour formed of a soft material, said contour having two faces separated by the burr, said device comprising a deburring tool comprised of plates made of an elastic cloth coated with abrasive and a rotary block driven by a motor and in which the plates are embedded at one end, said device further comprising an elastic system for flexing the burr onto one of the faces, the elastic system and the tool being secured to a same support and being moveable along the contour and the burr, the elastic system preceding the tool on the burr, the elastic system comprising at least one brush having elastic radial elements rotating around an axis roughly parallel to the faces of the contour and its attached burr.

2. A machining device according to claim 1, wherein the elastic system comprises two brushes each having elastic radial elements, each of said brushes rotating, in the same direction, around axes roughly parallel to the faces of the contour.

3. A machining device according to claim 1, and further including a sensor for estimating machining force, and means for adjusting the distance of the deburring tool to the contour with reference to the magnitude of the estimated machining force, wherein said sensor measures the speed of rotation of the deburring tool, and wherein said motor comprises a pneumatic motor.

* * * * *